United States Patent [19]

Daugherty et al.

[11] Patent Number: 4,776,619

[45] Date of Patent: Oct. 11, 1988

[54] SLIDING DOOR LOCK

[75] Inventors: Eugene F. Daugherty; Charles E. Holycross, both of San Antonio, Tex.

[73] Assignee: Southern Steel Company, San Antonio, Tex.

[21] Appl. No.: 858,377

[22] Filed: May 1, 1986

[51] Int. Cl.[4] ..... E05B 65/08; E05C 3/06

[52] U.S. Cl. ..... 292/201; 70/99; 70/279; 292/99; 292/108; 292/207; 292/210

[58] Field of Search ..... 70/95, 96, 98, 99, 100, 70/277, 279, 280, 282; 292/99, 201, 108, 100, 200, 210, 226, 236, 237, 207, 232, 233

[56] References Cited

U.S. PATENT DOCUMENTS

| | | | |
|---|---|---|---|
| 1,019,282 | 3/1912 | Strouse . | |
| 1,085,347 | 1/1914 | Leduc . | |
| 1,238,152 | 8/1917 | Kelloniemi | 70/98 |
| 1,434,371 | 11/1922 | Crompton et al. | 292/210 X |
| 1,736,761 | 11/1929 | Haffner | 70/282 |
| 1,946,384 | 2/1934 | Baril et al. . | |
| 2,294,683 | 9/1942 | Murphy | 292/99 |
| 2,601,775 | 7/1952 | Jewett et al. . | |
| 3,142,166 | 7/1964 | Adam et al. | 70/282 |
| 3,242,708 | 3/1966 | Sanchez . | |
| 3,751,088 | 8/1973 | Schlage | 292/201 |
| 3,785,187 | 1/1974 | Wolz | 70/280 X |
| 3,877,266 | 4/1975 | McLaughlin | 70/280 |
| 3,893,723 | 7/1975 | Boule | 292/140 |
| 4,395,064 | 7/1983 | Bellot et al. | 292/201 |
| 4,434,635 | 3/1984 | Borgato | 292/201 X |

FOREIGN PATENT DOCUMENTS

| | | | |
|---|---|---|---|
| 1394247 | 2/1965 | France | 70/277 |
| 263535 | 8/1913 | Fed. Rep. of Germany | 70/100 |
| 274242 | 5/1914 | Fed. Rep. of Germany | 70/99 |

*Primary Examiner*—Lloyd A. Gall

*Attorney, Agent, or Firm*—Pravel, Gambrell, Hewitt, Kimball & Krieger

[57] ABSTRACT

The lock assembly of the present invention is mounted in a lock frame. A slide member is disposed for translation within the lock frame. A lock bolt is pivotally mounted within the lock frame and extends through it for engagement with a door keeper in a door frame. A lock bolt detent is pivotally mounted to the slide member for maintaining the lock bolt in a secure position when the door is closed. Actuation of movement of the slide member results in movement of the lock bolt detent away from the lock bolt followed by pivotal motion of the lock bolt as a pin on the slide member engages the lock bolt and lifts clear of the door keeper. The door is sprung open by a spring loaded plunger which extends out of the lock frame.

24 Claims, 5 Drawing Sheets

SLIDING DOOR LOCK

FIELD OF THE INVENTION

The present invention relates to locks and security devices such as are used in prison security doors and the like. The disclosed lock assembly is particularly suited for use in a door locking system and may be operated remotely or locally adjacent to the door.

BACKGROUND OF THE INVENTION

Penal institutions frequently house inmates in dormitory-like cells or rooms which open to a common hall or corridor. In a prison environment it is, of course, mandatory that access to the cells by the inmates be controlled. It is desirable that such control be achieved either locally at each door or remotely from a secured central control room.

While previously known systems have attempted to provide such features, they have failed to achieve widespread acceptance due to a number of shortcomings such as technical complexity, functional inadequacy and high cost. For example, light weight electric solenoid bolt control devices have been previously proposed, such as the device disclosed in U.S. Pat. No. 3,893,723, wherein a bolt was actuated by a slide member 10 which moved between upper and lower solenoids. The device was unsatisfactory for high security installations since it was easily damaged by any substantial force applied to the bolt in its extended position. Any such force created a bending force on the solenoids and typically resulted in severe damage or destruction of the locking mechanism. The inmates' well known propensity for vandalism in penal institutions therefore rendered the device of this patent totally unsatisfactory for penal institution use.

Other penal door locking systems were not usable with conventional steel door jambs and door assemblies. The cost of custom door installations made such systems too expensive to be practical for use in government built penal institutions.

Other devices such as that shown in U.S. Pat. No. 1,946,384 have employed solenoid operated bolt members actuated by a pin and slot camming arrangement of complex construction suitable only for light duty in window sashes or the like.

U.S. Pat. No. 4,099,752 disclosed a lock in which an actuating solenoid for the bolt was mounted so that its plunger had an axis of movement perpendicular to the axis of movement of the lock bolt. The lock bolt also included a detent switch which energized a solenoid to lock the bolt when the door was closed.

Therefore, it is the object of the present invention to provide a new and improved door locking system for penal or similar institutions that is secure and relatively inexpensive to install.

It is yet another object of the present invention to provide a new and improved door locking system that can be operable from a remote site and from a position adjacent the door.

SUMMARY OF THE INVENTION

The lock assembly L of the present invention is mounted in a lock frame. The lock assembly L includes a slide member for actuating the lock mechanism disposed for translation within the lock frame by manual actuation with a key or in response to a control signal. A lock bolt is pivotally mounted within the lock frame and extends through it for engagement with a door keeper in a door frame. A lock bolt detent is pivotally mounted within the frame for maintaining the lock bolt in a secured position when the door is closed. Actuation of the slide member results in movement of the lock bolt detent away from the lock bolt followed by pivotal motion of the lock bolt as a pin on the slide member engages the lock bolt and lifts it clear of the door keeper. Once the lock bolt has been disengaged from the door keeper, the door is sprung open by a spring loaded plunger which extends out of the lock frame.

DETAILED DESCRIPTION OF THE PREFERRED EMBODIMENT

Figure 1:
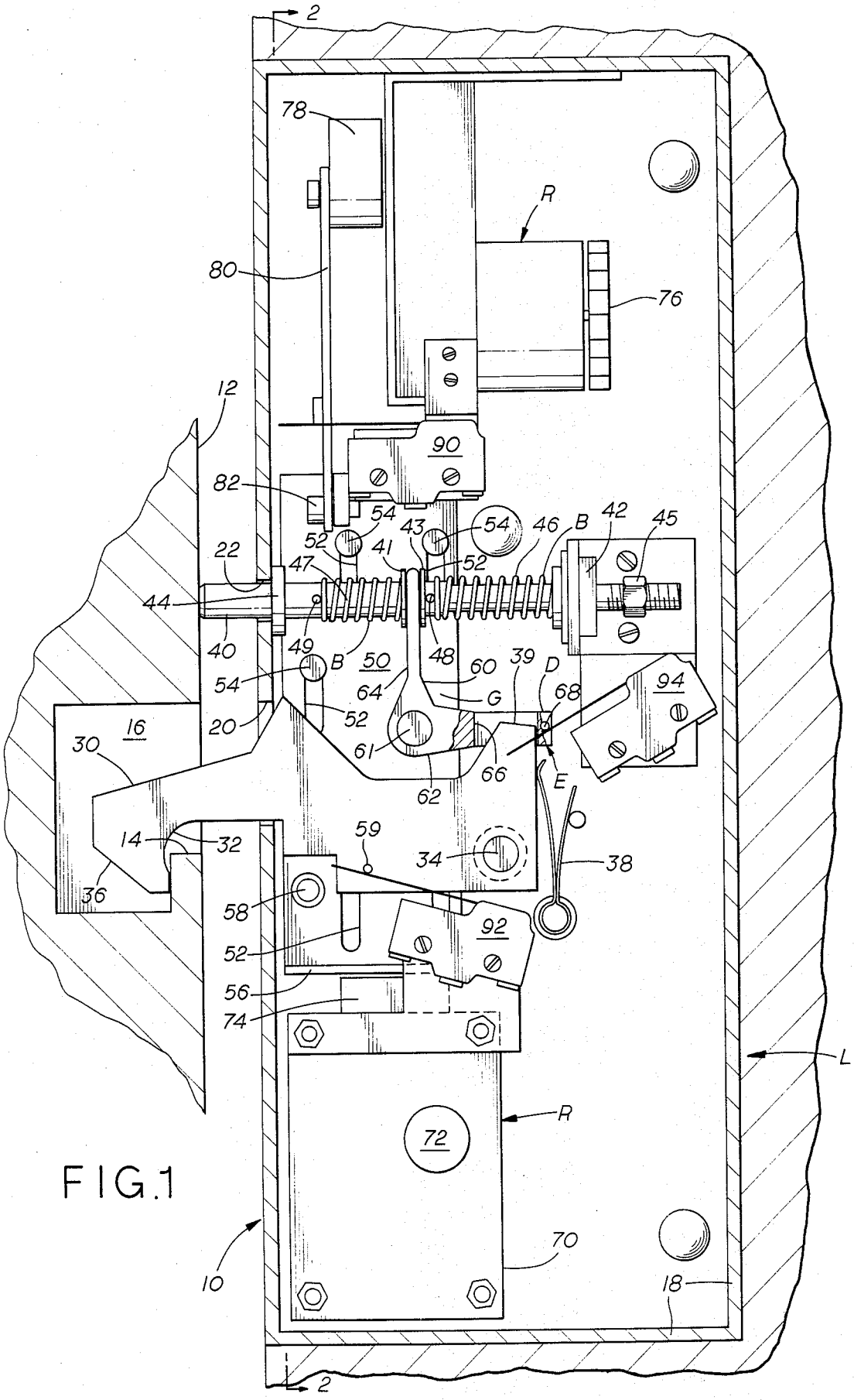
FIG. 1 is a side elevational view of the lock assembly of the present invention with the lock bolt in the deadlocked position.
Figure 3:
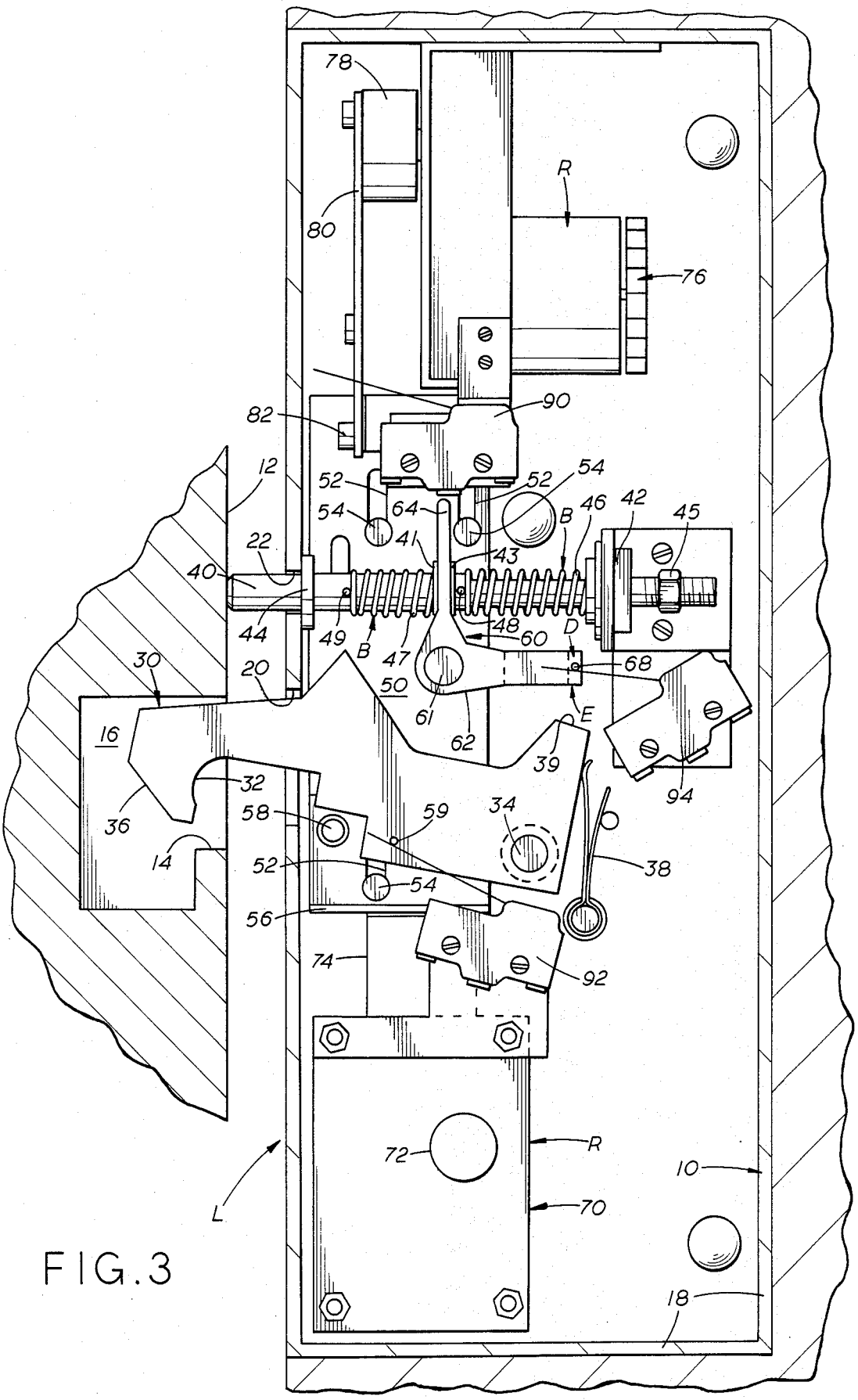
FIG. 3 is a side elevational view of the lock assembly of the present invention with the lock bolt in the open position as the door is being opened.

As best seen in FIG. 1, the lock assembly L is built around a lock frame 10. The lock frame 10 is designed to be fitted into a door frame or wall (not shown) and attached thereto by well known means. The lock frame 10 interacts with door 12 which is schematically illustrated in FIGS. 1 and 3. Door 12 further includes a door keeper 14. The above-described arrangement can be reversed without departing from the spirit of the invention. As can readily be seen, when the door is closed a lock bolt 30 travels over door keeper 14 and into receptacle 16, in the manner more fully described hereinbelow. In order to protect against vandalism, lock frame 10 is fabricated from 3/16 inch plate 18, for example. Lock frame 10 is formed having several openings to accommodate various elements of the lock assembly. Opening 20 allows lock bolt 30 to project from within lock frame 10 for engagement with door keeper 14. Opening 22 allows plunger 40 to project from lock frame 10 and contact the door 12 when it is closed.

Mounted within lock frame 10 are: a slide member 50; lock bolt 30; a lock bolt detent means D; a disabling means G and a drive means R. The function and operation of each of these elements is described in more detail hereinbelow.

Figure 2:
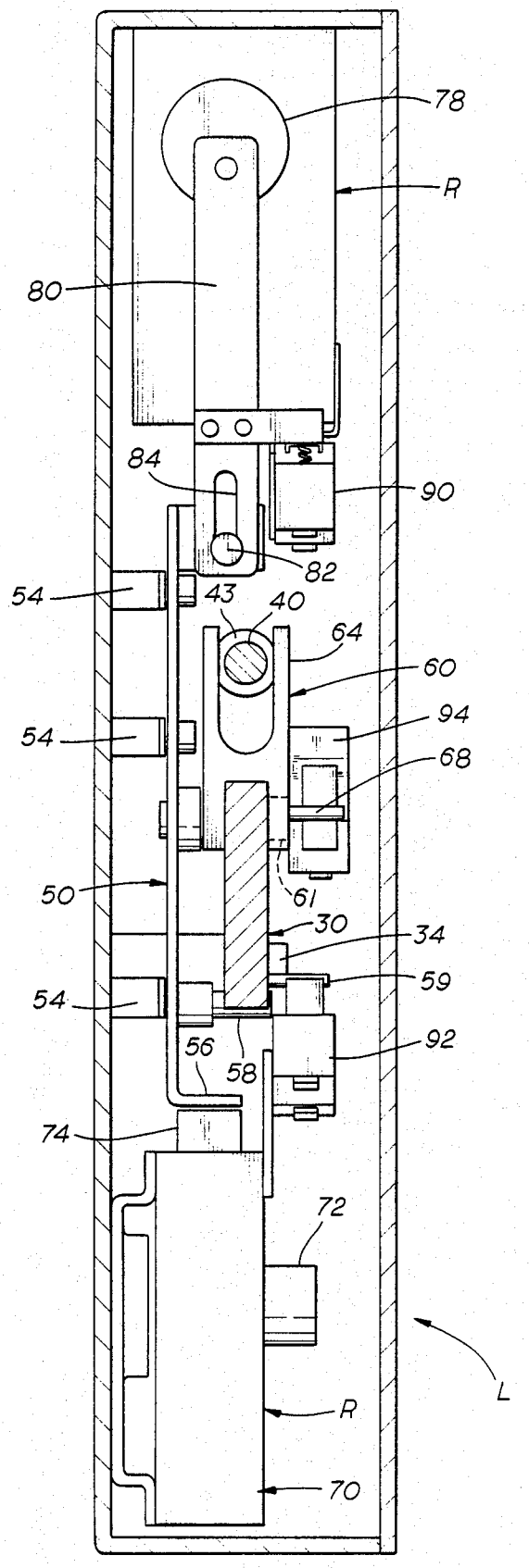
FIG. 2 is an end view of the invention taken along lines 2—2 of FIG. 1.

Slide member 50 is mounted to lock frame 10 in a manner which allows slide member 50 to translate in a direction parallel to the longitudinal axis of lock assembly L. To facilitate such translation, slide member 50 has a plurality of mounting slots 52 (see FIGS. 1 and 3). Each slot 52 has a bolt 54 extending therethrough and which is threaded into or otherwise secured to lock frame 10 (see FIG. 2). Slide member 50 further includes a lower flange 56 which is disposed in a plane perpendicular to the remainder of slide member 50 for operative engagement by drive means R (FIG. 2).

Drive means R includes a mechanical lock 70 which may be actuated by an attendant standing near the door. Mechanical lock 70 includes a lock cylinder 72 which when rotated through the use of a key forces a deadbolt 74 to extend from the mechanical lock 70 and bear on flange 56 of slide member 50. In this manner slide member 50 is displaced vertically in response to keyed operation of lock 70 in order to open the door. Reversed rotation of a key in lock cylinder 72 results in the retraction of deadbolt 74 back into mechanical lock 70. As a result, slide member 50 drops down vertically due to its own weight. The manual mechanical lock 70 is of a type known in the art such as that currently manufactured by Southern Steel Company of San Antonio, Tex. under Model No. 1010. As illustrated in FIG. 1, slide member 50 is in the locked position. As illustrated in FIG. 3, slide member 50 is in the unlocked position. While the illustrated embodiment relies upon the weight of slide member 50 to return it from the unlocked to the locked position, it should be understood that the lock assembly of the present invention may also include a biasing means, such as a spring or the like, to positively bias slide member 50 from the unlocked to the locked position.

Figure 4:
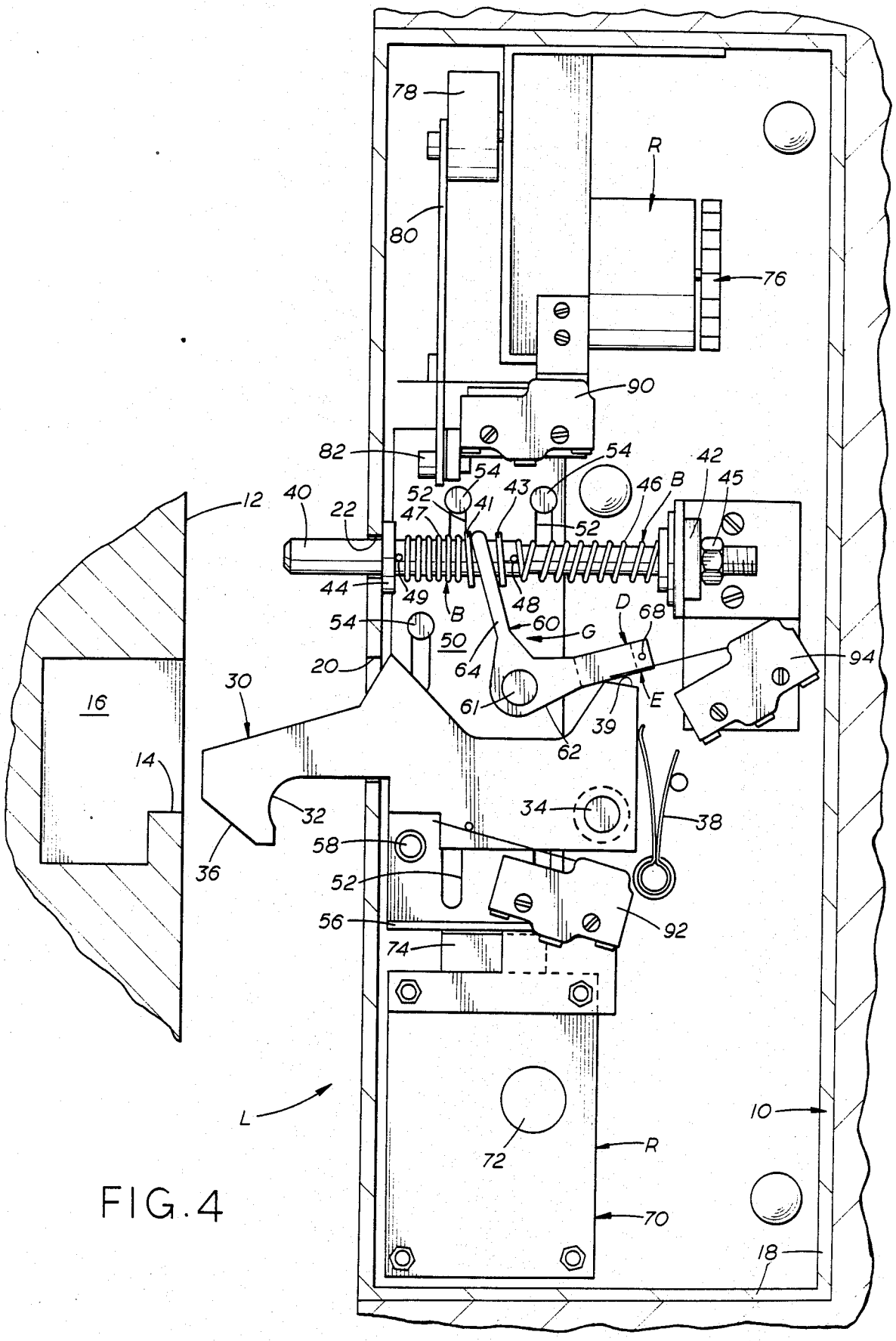
FIG. 4 is a side elevational view of the lock assembly of the present invention with the lock bolt in the open position as the door is being closed.

Referring now to FIG. 3, lock bolt 30 is pivotally mounted to lock frame 10 and extends through opening 20 out of lock frame 10. A hook shaped segment 32 of lock bolt 30 extends from lock frame 10 to engage door keeper 14 when the door is closed. Lock bolt 30 is pivotally mounted to lock frame 10 on pin 34 (see FIG. 2). In order to facilitate engagement between hook shaped segment 32 and door keeper 14, lock bolt 30 further includes a leading beveled edge 36. As the door is pushed from the open to the closed position, leading beveled edge 36 first contacts the door keeper 14 thereby pivoting lock bolt 30 around pin 34. As shown in FIG. 1, lock bolt 30 is in the secured position. As shown in FIG. 3, due to the interaction between leading beveled edge 36 and door keeper 14, lock bolt 30 has been rotated from the secured position toward the open position. FIG. 4 shows the lock bolt in the fully open position. Upon further movement of the door 12 toward the door frame leading beveled edge 36 is moved further into door keeper 14 and as a result, spring 38 biases lock bolt 30 toward the secured position. The action of spring 38 results in engagement between the hook shaped segment 32 and the door keeper 14, thereby locking the door. It should be noted that lock bolt 30 can be designed with sufficient weight in the hook shaped segment 32 so that spring 38 would not be necessary and lock bolt 30 will, by gravity, rotate counterclockwise toward the secured position after the leading beveled edge 36 has passed into door keeper 14. However, spring 38 is a desirable feature and is specifically included in specifications for locks by penal institutions in the United States.

It is desirable, that the design of the lock assemblies for penal institutions prevent inmates from using tools to rotate the lock bolt 30 from the secured position shown in FIG. 1 to the open position shown in FIG. 3 when the door is closed. In order to prevent rotation of lock bolt 30 when the door is closed, lock bolt detent means D engages detent tang 39 when the door is closed. Lock bolt detent means D comprises a generally L-shaped pivotally mounted link 60. Link 60 is pivotally connected to slide member 50 via pin 61 (see FIG. 2). Link 60 includes a horizontal component 62 and a vertical component 64. As shown in FIG. 1, the horizontal component 62 further includes an engagement means E to prevent rotation of lock bolt 30 about pin 34 when the door is closed and locked. In the illustrated embodiment, means E comprises a slot 66 adapted to engage detent tang 39 to prevent the lock bolt 30 from rotating about pin 34 when the door is closed and locked. It should be noted that alternative designs of the engagement means E of the horizontal component 62 of link 60 may be used without departing from the spirit of the invention. For example, the horizontal component 62 may have a depression therein or may in other ways interfere with the rotation of lock bolt 30 when the lock bolt is in the secured position.

As previously stated, the slide member 50 may be manually actuated by mechanical lock 70. However, drive means R also includes an alternative method of actuating slide member 50 from a secured remote location such as a central control room for prison guards. Drive means R includes a motor 76 operably connected to eccentric cam 78 through gearing or other methods known in the art. Eccentric cam 78 is connected through a linkage formed by the connection of rigid link 80 to slide member 50 via pin 82 (see FIG. 2). Pin 82 extends through a slot 84 in link 80. As can readily be seen from FIG. 2, the purpose of slot 84 is to allow actuation of slide member 50 via mechanical lock 70 without interfering with or affecting link 80.

When slide member 50 is raised via operation of motor 76 or mechanical lock 70, and the door is closed, pin 61 which is fixed to slide member 50 causes the horizontal component 62 of link 60 to rise. Pin 61 thus forms a part of disabling means G, as will be more fully described hereinbelow. As slide member 50 initially moves from the locked to the unlocked position, the vertical translation of pin 61 disengages slot 66 from detent tang 39. In this position, lock bolt 30 is free to rotate about pin 34. As slide member 50 is raised further, pin 58 engages lock bolt 30 to initiate its rotation about pin 34. It should be noted that at the time pin 58 contacts lock bolt 30, the slot 66 on horizontal component 62 of link 60 has already begun to move away from detent tang 39. Therefore, further vertical movement of slide member 50 from the locked to the unlocked position causes lock bolt 30 to pivot until hook shaped segment 32 is in the position shown in FIG. 3 allowing it to be withdrawn from the door keeper 14. In the preferred embodiment, a slight initial movement of slide 50, i.e. 5/32", moves slot 66 away from detent tang 39. Further movement of slide 50, i.e. 7/16", moves lock bolt 30 to the open position.

When lock bolt 30 is raised to the open position, withdrawing hook shaped segment 32 from door keeper 14 the door can be forced to slide open. A plunger 40 is guided within lock frame 10 by guides 42 and 44. Nut 45 attached to plunger 40 acts as a travel stop when it contacts guide 42. Plunger 40 serves to spring the door open as lock bolt 30 is pivoted from the secured to the open position via the action of a biasing means B secured to plunger 40. Biasing means B includes release spring 46 and return spring 47. The vertical component 64 of pivotally mounted link 60 is operably connected to plunger 40. As best seen in FIG. 2, the vertical component 64 is U-shaped with plunger 40 passing through it. Release spring 46 is mounted over plunger 40 and is secured to guide 42 on one end and pin 48 extending from plunger 40 at the other end. Return spring 47 is secured to plunger 40 via pin 49 at one end. The opposite end of return spring 47 bears against vertical component 64 by pressing against washer 41. Washer 41 is not essential and it should be understood that return spring 47 may bear directly against vertical component 64 without departing from the spirit of the invention.

When the door is closed and slide member 50 is actuated to raise lock bolt 30 from the secured to the open position (FIG. 3), biasing means B causes plunger 40 which bears against door 12 to force the door open as soon as hook shaped segment 32 has been positioned to be retracted from door keeper 14. Release spring 46 acting against pin 48 propels plunger 40 outwardly against door 12 thereby sliding the door open. In the preferred embodiment, release spring 46 has a higher spring rate or exerts more force per inch of compression than spring 47 so that as long as the door remains open (FIG. 4) release spring 46 overcomes the opposite force exerted by return spring 47. It should be noted that by reason of release spring 46 overcoming the opposing force produced by return spring 47, pivotally mounted link 60 is rotated counterclockwise to the position shown in FIG. 4. As can readily be seen from FIGS. 1 and 4, the pin 48 acting against washer 43 which bears against vertical component 64 results in rotation of vertical component 64 about pin 61. Due to the higher spring rate of release spring 46 as compared to return spring 47, as long as the door remains open, the pivotally mounted link 60 remains in the position shown in FIG. 4. In the preferred embodiment, pivotally mounted link 60 is forced to rotate approximately 10° to 15°, although other degrees of rotation may be used without departing from the spirit of the invention.

As previously mentioned, rotation of link 60 results in slot 66 moving away from detent tang 39. It is necessary to maintain slot 66 away from detent tang 39 while the door is open so that lock bolt 30 is free to pivot about pin 34 as long as the door is left open (FIG. 4). This feature is desirable so that the door may automatically lock when slammed shut. By way of further explanation, whether slide member 50 is actuated to move from the locked to the unlocked position via motor 76 or mechanical lock 70, slide member 50 moves in one complete cycle from locked to unlocked and back to the locked position. In motor driven embodiments, a limit switch 90 is provided which causes motor 76 to be actuated through one complete revolution whenever the guard at a remote location actuates motor 76. A second limit switch, not shown can be used to stop the motor 76 after half a revolution thereby keeping the lock in the unlocked position as long as desired. As motor 76 completes one revolution, slide member 50 will move in one smooth motion from the locked to the unlocked and back to the locked position. Similarly, when the lock assembly L is operated via a mechanical lock 70, the guard may use a key to extend deadbolt 74 to open the door and then withdraw the key thereby retracting deadbolt 74 back into mechanical lock 70 after the door has sprung open. Thus, after the door has been pushed open due to the action of plunger 40 biased by release spring 46, the components within lock frame 10 come to rest in the position shown in FIG. 4, with link 60 deflected 10° to 15° counterclockwise from its position in FIG. 1 and retained in that position due to the spring rate of release spring 46 exceeding the spring rate of return spring 47.

When it is desired to close the door 12, (FIG. 4), the door is slid toward the door frame containing the lock assembly L. Since the hook shaped segment 32 of lock bolt 30 extends from lock frame 10 further than plunger 40, initial contact is first made between leading beveled edge 36 and door keeper 14. The net result is that lock bolt 30 is pivoted from the locked position toward the unlocked positon in a clockwise direction until leading beveled edge 36 clears the door keeper 14 whereupon spring 38 biases lock bolt 30 in a counterclockwise direction resulting in engagement of the hook shaped segment 32 within door keeper 14. Just as the leading beveled edge 36 clears the door keeper 14, plunger 40 contacts door 12. Further inward movement of the door 12 toward the door frame results in compression of release spring 46. In essence, release spring 46 is compressed by movement of pin 48 toward guide 42. As a result, return spring 47, which has previously been compressed when the door was opened, bears against washer 41 and causes pivotally mounted link 60 to rotate clockwise about pin 61 until link 60 is in the position shown in FIG. 1. Therefore, it is preferred that the extension of plunger 40 when the door is opened be preset such that rotation of link 60 commences with rotation of lock bolt 30 toward the secured position when leading beveled edge 36 clears door keeper 14. In that circumstance, as soon as lock bolt 30 has completed its travel from the open to the secured position, slot 66 formed in horizontal component 62 is in position for engagement with detent tang 39. The net result is that upon engagement of hook shaped segment 32 into door keeper 14, the interaction between slot 66 and detent tang 39 prevents rotation of lock bolt 30 out of the secured position.

Figure 6:
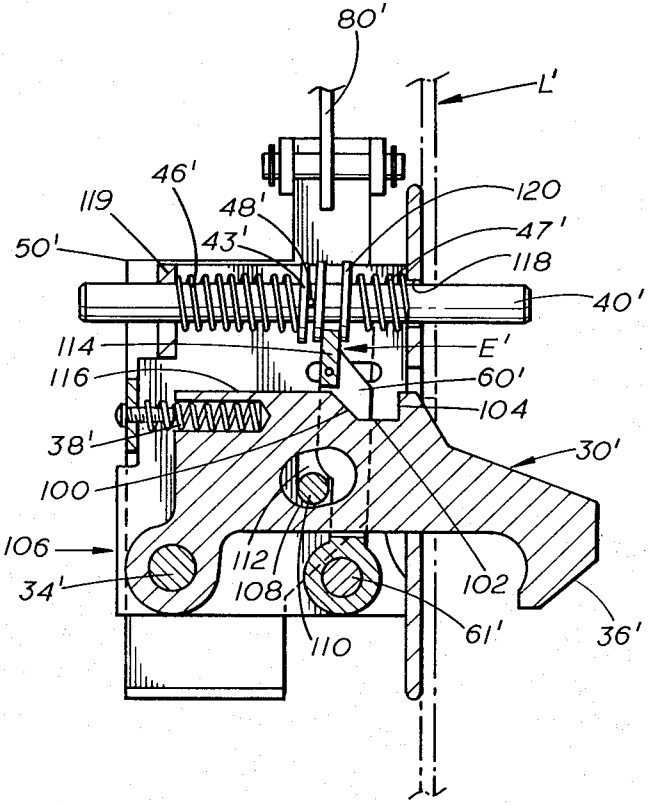
FIG. 6 is a detailed sectional elevational view of the alternative embodiment of the lock assembly shown in FIG. 5.
Figure 5:
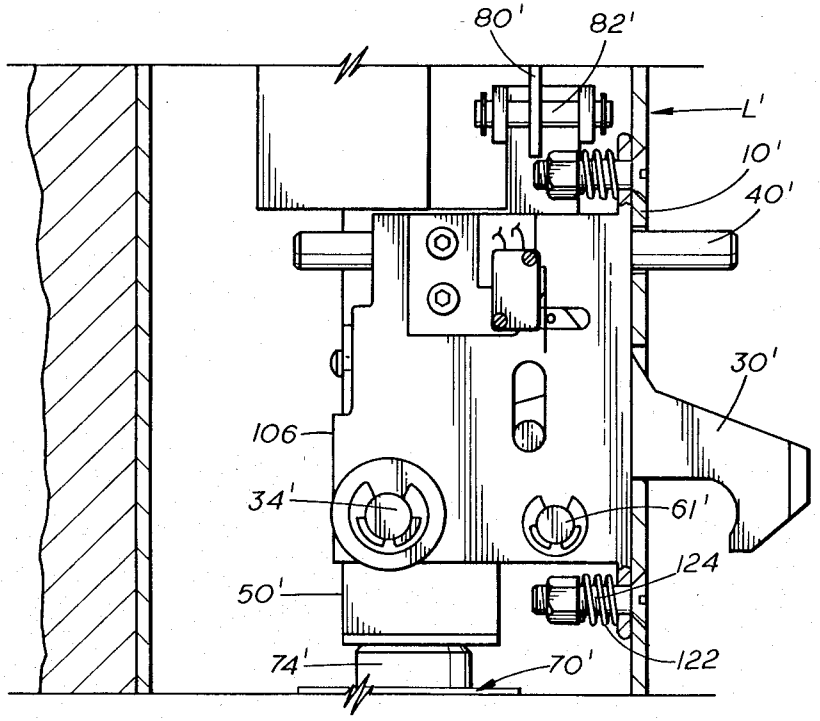
FIG. 5 is a sectional elevational view of an alternative embodiment of the lock assembly.

As shown in FIG. 1, plunger 40 is guided by guides 42 and 44 and further has spring forces from release spring 46 and return spring 47 acting on it. As indicated in FIG. 1, when the door is closed, the normal position for plunger 40 is in the deadlocked position. However, it is possible that inmates may attempt to vandalize plunger 40 by attaching foreign objects to door 12 with the intent of damaging lock assembly L by overtravel of plunger 40. Alternatively, inmates may attempt to damage the lock by jamming lock bolt 30 in the locked position and slamming the door 12 into it. The lock assembly of the present invention compensates for such attempts at vandalism by providing freedon for plunger 40 to move into the overtravel position (see FIG. 1). Additionally, the lock bolt 30 can be resiliently mounted to frame 10 (FIGS. 5 and 6). Accordingly, none of the internal components will be damaged if an inmate maliciously attaches a foreign object to door 12 at the point of contact with plunger 40. The indirect link between pivotally mounted link 60 and plunger 40 also serves to prevent vandalism to the lock assembly L. As shown in FIG. 1, plunger 40 and link 60 are not rigidly connected. Instead, any force applied to plunger 40 as might occur in an inmate's attempt to damge the lock assembly will be transmitted to release spring 46 and return spring 47 rather than directly to link 60.

Due to the propensity of inmates to vandalize locks, it is desirable to be able to determine the position of lock bolt 30 from a remote location such as a control room monitored by prison guards. To this end, pin 59 acting in conjunction with lock bolt limit switch 92 provide a signal to a remote location that the lock bolt 30 is in the secured position. Similarly, pin 68 acting in conjunction with lock bolt detent limit switch 94 provide a signal that pivotally mounted link 60 has achieved the position shown in FIG. 1 wherein it effectively precludes rotation of lock bolt 30 clockwise out of the secured position to the opened position.

An alternative embodiment is disclosed in FIGS. 5 and 6. The operation of this embodiment is in many respects identical to the lock assembly as previously discussed in FIGS. 1 through 4. However, there are a few differences as will be discussed hereinbelow. The principal area of difference lies in engagement means E'. As seen in FIG. 6, lock bolt 30' has a depression defined by surfaces 100, 102 and 104. AS before, rigid link 80' is in contact with slide member 50' to urge slide member 50' to selectively move upwardly or downwardly. A suitably connected motor (not shown) can actuate rigid link 80'. Alternatively, slide member 50' can be manually actuated with a key lock assembly 70' (FIG. 5).

It should be noted that link 60' is pivoted around pin 61'. Pin 61' is connected to carriage 106 which supports not only link 60' but also lock bolt 30' via pivot pin 34'.

Lock bolt 30' further includes an internal opening 108. Pin 110 extends from slide member 50' through carriage 106 and opening 108. Link 60' has a curved surface 112 thereon. Upward movement of slide 50' causes pin 110 to engage curved surface 112 thereby rotating link 60' clockwise about pin 61'. The clockwise rotation of link 60' moves engagement means E' which comprises a tab 114. In the position as shown in FIG. 6, tab 114 is disposed over surface 116 of lock bolt 30'. Thus, in the position shown in FIG. 6, engagement means E' is enabled thereby preventing lock bolt 30' from pivoting about pin 34' due to the interaction of tab 114 with surface 116. However, when pin 110 engages curved surface 112 as a result of upward movement of slide 50', link 60' is rotated clockwise along with tab 114. Thus lab 114 is juxtaposed against the depression defined by surfaces 100, 102 and 104 on lock bolt 30'. Subsequently, after pin 110 causes link 60' to rotate clockwise, further elevation of slide member 50' results in pin 110 raising lock bolt 30' by engagement with internal opening 108. It should be noted that clockwise displacement of link 60' results in compression of spring 47' as a result of tab 114 pressing against washer 120. As in the embodiments of FIGS. 1–4, when lock bolt 30' clears the door keeper 14, spring 46' overcomes the force of spring 47' and propels plunger 40' outwardly from lock assembly L'. Spring 46' acts against washer 43' which is retained by pin 48' to plunger 40'. Thus, as long as the door remains opened, spring 46' overcomes the force of spring 47' thus retaining the engagement means in the disabled position wherein tab 114 is juxtaposed opposite the depression in lock bolt 30' as defined by surfaces 100, 102 and 104.

Since the lock bolt 30' extends further than plunger 40', upon closing the door, leading beveled edge 36' engages the door keeper 14 (See FIG. 1) whereupon lock bolt 30' is caused to rotate counterclockwise. The forward end of lock bolt 30' clears door keeper 14 and enters receptacle 16 (See FIG. 1). Due to the extension of plunger 40' from lock assembly L, the engagement means E' remains disabled as the lock bolt 30' rotates counterclockwise and its leading edge enters receptacle 16 behind doorkeeper 14. Further movement of the door causes plunger 40' to engage the door with a resultant inward displacement of plunger 40' into lock assembly L'. This inward displacement causes spring 46' to be compressed as a result of pin 48' pushing against washer 43'. Simultaneously, forces acting to compress spring 47' are relieved thereby causing washer 120 to displace tab 114. Displacement of tab 114 results in counterclockwise rotation of link 60' to the position shown in FIG. 6. Thus, when the door is fully closed, tab 114 will be in the position shown in FIG. 6. The door will then be locked due to the lock bolt 30' being in position within receptacle 16 and engagement means E' being placed in the enabled position as a result of the forces exerted by spring 47' on the tab 114. It should be noted that no movement of slide member 50' is necessary in order to close and lock the door. The door merely needs to be slammed shut.

Another beneficial feature of the invention is illustrated in FIG. 5. Carriage 106 supports lock bolt 30' via pin 34'. Additionally, as shown in FIG. 6, plunger 40' is supported off of carriage 106 by extending through the carriage at a point marked 118 on one end and via support of a strut 119 at the opposite end. Carriage 106 is resiliently mounted to lock frame 10' through the use of a plurality of springs 122 straddling bolts 124 or any other equivalent means. Thus, as seen in FIG. 5, if an inmate attempts to vandalize the lock assembly L' of the present invention by somehow manually holding lock bolt 30' in the deadlock positions shown in FIG. 6 and slamming the door shut against it, springs 122 provide sufficient resiliency in the mounting of the lock bolt 30' to the lock assembly L' to avoid doing damage to the lock bolt 30'. Thus slamming the door against lock bolt 30' in the deadlock position merely results in displacement of carriage 106 which is guided by bolts 124. Springs 122 resist forces applied to lock bolt 30' and keep carriage 106 abutting lock frame 10'. In order to allow for lateral movement of carriage 106, link 80' is mounted to pin 82' as to allow lateral movement of pin 82' without corresponding movement to link 80'. Thus, carriage 106 can be laterally displaced without any bending moments applied to link 80'. Similarly, if a manual lock 70' is employed, the deadbolt 74' is so positioned below slide member 50' to allow relative displacement of slide member 50' with respect to deadbolt 74'. Thus, when vandals apply forces against lock bolt 30', and such forces are transmitted to slide member 50' via carriage 106, there is no resulting damage to either carriage 106 or slide member 50' due to the resilient mounting of carriage 106 via springs 122 mounted over bolts 124. A similar carriage mounting of plunger 40 and lock bolt 30 can be employed in the embodiment of FIG. 1.

The foregoing disclosure and description of the invention are illustrative and explanatory thereof, and various changes in the size, shape and materials, as well as in the details of the illustrated construction may be made without departing from the spirit of the invention.

We claim:

1. A lock assembly in combination with a door assembly that includes a door frame, a door keeper, and a sliding door movably mounted in the door frame, comprising:

a. a lock frame supported by the door assembly, positioned in proximity to the door keeper when the sliding door is closed and positioned away from the door keeper when the sliding door is opened;

b. a slide member movably mounted within the lock frame between a first locked position and a second unlocked position;

c. a lock bolt member mounted within the lock frame and positioned to be engaged by and travel with the slide member between locked and unlocked positions, the lock bolt member including connecting means partially extending from the lock frame for forming a connection with the door keeper that locks the sliding door when the slide member is in the first locked position and the slide member disengages the connecting means and door keeper when the slide member moves to the second unlocked position;

d. lock bolt detent means for preventing movement of the lock bolt member to the unlocked position when the slide member is in the first locked position;

e. disabling means for spacing the lock bolt member and the detent means apart responsive to movement of the slide member from the first locked position to the second unlocked position; and f. means for holding the detent means in a spaced position from the lock bolt member and independently of slide member travel so that the door can slam lock when the lock bolt member engages the door keeper.

2. The lock assembly of claim 1 wherein:

the lock bolt detent means is pivotally mounted to the slide member.

3. The lock assembly of claim 2 wherein:

the lock bolt member is pivotally mounted within the lock frame.

4. The lock assembly of claim 1 wherein:

the lock bolt member is further formed having a depression thereon;

the lock bolt detent means is a pivotally mounted link having an engagement means thereon for selectively allowing the lock bolt member to pivot;

whereupon initial movement of the slide member causes movement of the link disabling the engagement means by aligning the engagement means adjacent the depression on the lock bolt member.

5. The lock assembly of claim 4 wherein:

the slide member further includes a pin positioned on the slide member to engage the lock bolt member after the engagement means on the pivotally mounted link has been disabled as a result of initial slide member movement from the locked to the unlocked position.

6. The lock assembly of claim 5 wherein the portion of the lock bolt member extending from the lock frame further comprises:

a hook shaped segment for engaging the door keeper; and the pin on the slide member selectively pivots the lock bolt member to allow the hook shaped segment of the lock bolt member to be withdrawn and inserted into the door keeper.

7. The lock assembly of claim 6 wherein the lock bolt member further comprises:

a leading beveled edge in the hook shaped segment, the leading beveled edge engaging the door keeper as the door is closed thereby forcing the lock bolt member to pivot toward the unlocked position and allowing the hook shaped segment of the lock bolt member to enter the door keeper and pivot toward the locked position.

8. The lock assembly of claim 7 wherein the disabling means comprises in part:

a slidably mounted plunger mounted transversely to the lock frame and adapted to partially extend therefrom, the plunger adapted to bear against the door when the door is closed; and the pivotally mounted link is operably connected to the plunger so that the link can pivot when the plunger slides with respect to the frame.

9. The lock assembly of claim 8 wherein:

the lock bolt member and the plunger are mounted on a common carriage;

the carriage is resiliently mounted to the lock frame.

10. The lock assembly of claim 8 further including:

biasing means operably connected to the plunger for selectively enabling and disabling the engagement means on the link as the plunger moves into and out of contact with the door.

11. The lock assembly of claim 10 wherein:

the biasing means further comprises a release spring, biasing the plunger from the lock frame when the slide member is moved from the locked to the unlocked position and the pin thereon pivots the hook shaped segment of the lock bolt member into the unlocked position, whereupon the plunger pushes the door open.

12. A lock assembly in combination with a door assembly that includes a door frame, a sliding door movably mounted in the door frame, and a door keeper, comprising:

a. a lock frame supported by the door assembly, positioned in proximity to the door keeper when the sliding door is closed, and positioned away from the door keeper when the sliding door is opened;

b. a slide member movably mounted within the lock frame between a first lower and a second higher position along a generally vertical path;

c. a horizontally extending lock bolt member mounted within the lock frame and having means extending therefrom for engaging the door keeper to lock the door, such means having a hook shaped segment with a leading beveled edge, the lock bolt member being positioned to engage the slide member for movement therewith between locked and unlocked positions corresponding respectively to the first and second positions of the slide member;

d. plunger means for thrusting the door open when the lock bolt member moves to the unlocked position;

e. a release spring urging the plunger means to extend out of the lock frame;

f. lock bolt detent means, mounted upon the slide member for travel therewith, for maintaining the lock bolt member in the locked position when the slide member is in the first position;

g. means for disabling the lock bolt detent means, responsive to movement of the slide member from the first lower position toward the second upper position thereby allowing the door to open; and h. the disabling means including holding means for keeping the detent means and lock bolt member in spaced apart positions and independently of slide member movement after the sliding door is opened.

13. A lock assembly in combination with a door assembly that includes a door frame, a door keeper, and a sliding door movably mounted in the door frame and with respect to the door keeper, comprising:

a. a lock frame mounted on the door assembly in a position spaced from the door keeper so that the door keeper and lock frame can move relative to each other when the sliding door opens and closes;

b. a key-operated slide member movably mounted within the lock frame between first and second positions;

c. a lock bolt member movably mounted upon the lock frame for movement independently of the slide member but positioned to travel with the slide member at least when the slide member moves from the first to the second position, which moves the lock bolt member from a locked position to an unlocked position;

d. the lock bolt member including means extending from the lock frame for perfecting a tensile connection with the door keeper that prevents opening of the sliding door, such means having a hook shaped segment with a leading beveled edge;

e. powered plunger means for thrusting the door open when the lock bolt member moves to the unlocked position;

f. release spring urging the plunger means to extend out of the lock frame;

g. detent means carried by the slide member for preventing movement of the lock bolt member when the slide member is in the first position; and h. disabling means for holding the detent means in a position spaced from the lock bolt member when the sliding door and door keeper are disengaged so that the lock bolt member is free to move between locked and unlocked positions when the sliding door is open and comprising in part a member that forms a connection with the powered plunger means.

14. The lock assembly of claim 12 or 13 wherein:

the leading beveled edge of the lock bolt member extends further out of the lock frame than the plunger when the door is open; and the leading beveled edge engages the door keeper upon closure of the door and pivots the lock bolt member from the locked toward the unlocked position, then when the leading beveled edge has cleared the door keeper, the hook shaped segment has moved into the locked position before the detent means engages the lock bolt member.

15. The lock assembly of claim 14 wherein the weight of the hook shaped segment of the lock bolt member is sufficient to pivot the lock bolt member so that the hook shaped segment falls into engagement with the door keeper after the leading beveled edge enters the door keeper.

16. The lock assembly of claim 15 further including:

biasing means mounted to the lock frame for urging the hook shaped segment of the lock bolt member toward the locked position after the leading beveled edge enters and clears the door keeper.

17. The lock assembly of claim 16 further comprising:

drive means within the lock frame for actuating movement of the slide member between the locked and unlocked positions, thereby allowing the door to be opened.

18. The lock assembly of claim 17 wherein the drive means further comprises:

a motor;

an eccentric cam driven by the motor;

a linkage comprising a rigid link formed having a slot therein connecting the cam to the slide member; and whereupon revolution of the motor the slide member is driven from the locked position to the unlocked position, whereupon the plunger pushes the door open.

19. The lock assembly of claim 18 further including:

a motor limit switch to selectively stop the motor after the motor has made the slide member cycle from the locked position to the unlocked position and to selectively stop the motor after movement of the slide member back to the locked position.

20. The lock assembly of claim 19 wherein the motor is actuable from a location remote from the door.

21. The lock assembly of claim 18 wherein the drive means further includes:

a lock cylinder mounted in the lock frame;

a dead bolt driven by the lock cylinder for movement of the slide member from the locked to the unlocked position; and the dead bolt selectively moving the slide member without moving the rigid link due to the slot therein, thereby allowing the lock assembly to be either remotely actuated or locally actuated.

22. The lock assembly of claim 21 further including:

a lock bolt limit switch mounted in the lock frame for remotely signaling the position of the lock bolt member as being in the locked position; and a detent means switch for remotely signaling the engagement of the detent means with the lock bolt member.

23. The lock assembly of claim 22 further including:

a guide for the plunger, the guide defining the maximum outward movement of the plunger when the door is opened and the plunger is outwardly driven by the release spring;

the plunger adapted for displacement through the guide to a deadlocked position at which the detent means prevents movement of the lock bolt member, when the door is closed and one end of the plunger extends from the lock frame into contact with the door; and the plunger adapted for further displacement into the lock frame beyond the deadlocked position into an over travel position.

24. The lock assembly of claim 23 wherein:

the lock bolt member and the plunger are mounted on a common carriage; and the carriage is resiliently mounted to the lock frame.

* * * * *